US007297228B2

(12) United States Patent
Anderson et al.

(10) Patent No.: US 7,297,228 B2
(45) Date of Patent: Nov. 20, 2007

(54) PROCESS FOR MANUFACTURING A CELLULOSIC PAPER PRODUCT EXHIBITING REDUCED MALODOR

(75) Inventors: Ralph Anderson, Marietta, GA (US); Tameka Spence, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 648 days.

(21) Appl. No.: 10/361,841

(22) Filed: Feb. 10, 2003

(65) Prior Publication Data

US 2003/0155089 A1 Aug. 21, 2003

Related U.S. Application Data

(63) Continuation-in-part of application No. 10/039,236, filed on Dec. 31, 2001.

(51) Int. Cl.
*D21F 11/00* (2006.01)

(52) U.S. Cl. ..... 162/158; 162/184; 162/168.1; 162/135; 162/186; 428/153

(58) Field of Classification Search ..... 162/158, 162/184, 168.1, 135, 186, 112; 428/153
See application file for complete search history.

(56) References Cited

U.S. PATENT DOCUMENTS

| | | | | |
|---|---|---|---|---|
| 3,303,576 | A * | 2/1967 | Sisson | 34/115 |
| 3,305,392 | A | 2/1967 | Britt | |
| 3,779,791 | A * | 12/1973 | Ploetz et al. | 422/1 |
| 3,840,395 | A | 10/1974 | Koch | |
| 4,002,486 | A | 1/1977 | Kotani et al. | |
| 4,863,987 | A | 9/1989 | Hoshino et al. | |
| 4,994,146 | A | 2/1991 | Soerens | |
| 5,048,589 | A | 9/1991 | Cook et al. | |
| 5,122,407 | A | 6/1992 | Yeo et al. | |
| 5,300,192 | A | 4/1994 | Hansen et al. | |
| 5,308,896 | A | 5/1994 | Hansen et al. | |
| 5,352,480 | A | 10/1994 | Hansen et al. | |
| 5,575,891 | A | 11/1996 | Trokhan et al. | |
| 5,624,532 | A | 4/1997 | Trokhan et al. | |
| 5,624,676 | A | 4/1997 | Mackey et al. | |
| 5,705,164 | A | 1/1998 | Mackey et al. | |
| 5,981,044 | A | 11/1999 | Phan et al. | |
| 5,998,032 | A | 12/1999 | Hansen et al. | |
| 6,033,523 | A | 3/2000 | Dwiggins et al. | |
| 6,068,731 | A | 5/2000 | Dwiggins et al. | |
| 6,120,644 | A | 9/2000 | Schroeder et al. | |
| 6,126,784 | A | 10/2000 | Ficke et al. | |
| 6,143,131 | A | 11/2000 | Dwiggins et al. | |
| 6,149,767 | A | 11/2000 | Hermans et al. | |
| 6,156,157 | A | 12/2000 | Schroeder et al. | |
| 6,162,329 | A * | 12/2000 | Vinson et al. | 162/158 |
| 6,187,141 | B1 | 2/2001 | Takeuchi et al. | |
| 6,190,735 | B1 | 2/2001 | Radwanski et al. | |
| 6,200,418 | B1 | 3/2001 | Oriaran et al. | |
| 6,207,012 | B1 | 3/2001 | Oriaran et al. | |
| 6,228,216 | B1 | 5/2001 | Lindsay et al. | |
| 6,241,850 | B1 | 6/2001 | Kelly | |
| 6,254,724 | B1 | 7/2001 | Seltzer et al. | |
| 6,395,395 | B1 | 5/2002 | Hansen et al. | |
| 2003/0155089 | A1 | 8/2003 | Anderson et al. | |

FOREIGN PATENT DOCUMENTS

| | | | |
|---|---|---|---|
| WO | WO 96/08601 A1 | | 3/1996 |
| WO | WO 97/06306 | | 2/1997 |
| WO | WO 97/06307 | | 2/1997 |
| WO | WO 01/18310 | * | 3/2001 |
| WO | WO 01/18310 A1 | | 3/2001 |

OTHER PUBLICATIONS

International Search Report from PCT/US 02/39570 dated Sep. 29, 2003.
International Search Report from PCT/US 2004/000861 dated Jun. 29, 2004.
Smook GA, "Paper Manufacture—Dry End Operations", Handbook for Pulp & Paper Technologists, 1992, 264-265.
Cullis, C.F., "Combusion of Cigarette Paper Under Conditions Similar to Those During Smoking", *Cellulose & Its Derivatives*, 1985, Chapter 35, Kennedy et al., eds., Ellis Horwood Ltd.
LeVan, S.L., "Chemistry of Fire Retardancy", *The Chemistry of Solid Wood*, 1984, Chapter 14, R. Rowell, editor, Advances in Chemistry Series 207 American Chemical Society.
Shafizadeh, F., "Thermal Degradation of Cellulose", *Cellulose Chemistry and its Applications*, 1985, Chapter 11, Nevell & Zeronian, eds., Ellis Horwood Ltd.
Wilk, K., et al., "Studies on Odour Reduction in TCF Bleached Packaging Paper", *Journal of Pulp and Paper Science*, Sep. 1998, vol. 24, No. 9.

* cited by examiner

*Primary Examiner*—Mark Halpern
(74) *Attorney, Agent, or Firm*—Armstrong Teasdale LLP

(57) ABSTRACT

A process for manufacturing a cellulosic paper product (e.g., paper hand towels) exhibiting reduced malodor upon wetting. The process comprises forming an aqueous suspension of papermaking fibers, depositing the aqueous suspension onto a sheet-forming fabric to form a wet web, drying the web at high temperature in an oxidative environment and topically applying a liquid glycol composition comprising a glycol compound selected from the group consisting of polyethylene glycol, triethylene glycol, glycerol and mixtures thereof to the web having a dry weight consistency of at least about 80%. The process of the present invention is particularly suited for reducing malodor released from cellulosic paper products made from through-air dried base sheet material.

23 Claims, No Drawings

PROCESS FOR MANUFACTURING A CELLULOSIC PAPER PRODUCT EXHIBITING REDUCED MALODOR

CROSS-REFERENCE TO RELATED APPLICATIONS

This application is a continuation-in-part of U.S. patent application Ser. No. 10/039,236, filed Dec. 31, 2001, the entire disclosure of which is incorporated herein by reference.

FIELD OF THE INVENTION

The present invention relates, in general, to processes for manufacturing cellulosic paper products and, more particularly, to such processes which provide cellulosic base sheets or finished products (e.g., hand towels) that release reduced malodor upon re-wetting.

BACKGROUND OF THE INVENTION

Commercial paper products such as hand towels are manufactured from cellulosic base sheets. A cellulosic base sheet is a paper product in its raw form prior to undergoing conventional post-treatments such as calendaring and embossing. In general, cellulosic base sheets are made by preparing an aqueous suspension of papermaking fibers and injecting or depositing the suspension onto an endless sheet-forming fabric to form a wet-laid web, which is then dewatered and dried to produce a base sheet suitable for finish processing.

Because of its commercial availability and practicality, through-drying is often used to dry base sheet material. Through-drying involves removing water from a wet-laid web by passing a heated gas (e.g., air) through the web. More specifically, through-air drying typically comprises transferring a partially dewatered, wet-laid web from a sheet-forming fabric to a coarse, highly permeable through-drying fabric. A stream of heated air is passed through the wet web carried on the through-drying fabric as it runs over the high permeability rotating cylinder or drum of a through-drying apparatus. As the hot, dry air contacts the wet web, water is evaporated from the web and is transferred to the flow of drying air. Processes for making cellulosic base sheets including through-drying are described, for example, in U.S. Pat. No. 5,607,551 (Farrington et al.) and U.S. Pat. No. 6,149,767 (Hermans et al.), the entire disclosures of which are incorporated herein by reference.

It has been observed that a strong, burnt popcorn-like odor is sometimes emitted from finished paper hand towels when the towels are wetted (i.e., re-wetted after final drying of the base sheet from which the towel is made). Upon investigation, this problem of malodor release has been found to be particularly present in paper products made from cellulosic base sheets that have been through-air dried at relatively high air temperatures. It was hypothesized that over-drying or over-heating of the base sheets was leading to the malodor problem upon re-wetting of the paper product. By operating the through-air drying stage of a base sheet manufacturing process at a lower temperature and compensating with slightly longer sheet residence times on the drying drum, the malodor problem can be largely eliminated. However, longer residence times in the through-drying apparatus adversely affect the overall productivity of the base sheet manufacturing process.

Therefore, what is lacking and needed in the art is a process which can reduce or eliminate malodor released upon re-wetting of paper products, particularly those made from through-air dried cellulosic base sheets, while allowing higher air drying temperatures and shorter dryer residence times to be used to increase product throughput and productivity.

SUMMARY OF THE INVENTION

Among the several objects of the present invention, therefore, is the provision of a process for manufacturing a cellulosic paper product from a wet-laid web; the provision of such a process wherein the paper product exhibits a reduced malodor upon re-wetting; the provision of such a process wherein the wet-laid web can be through-air dried at higher temperatures and shorter dryer residence times; the provision of such a process wherein productivity and throughput of the manufacturing process are increased; and the provision of such a process which is relatively inexpensive and easy to implement.

Briefly, therefore, the present invention is directed to a process for manufacturing a cellulosic paper product comprising forming an aqueous suspension of paper making fibers, depositing the aqueous suspension of paper-making fibers onto a sheet-forming fabric to form a wet web and through-drying the web by passing a heated gas through the web. In accordance with the present invention, a liquid glycol composition comprising a glycol compound selected from the group consisting of polyethylene glycol, triethylene glycol, glycerol and mixtures thereof is topically applied to the web having a dry weight consistency of at least about 80%. In accordance with a more particular embodiment, the web is partially dewatered prior to through-drying the web by passing air heated to a temperature of at least about 175° C. through the web and the liquid glycol composition comprises polyethylene glycol having a molecular weight of from about 400 to about 800 and is topically applied to the dried web having a dry weight consistency of at least about 90% by weight.

Other objects and features of the present invention will be in part apparent and in part pointed out hereinafter.

DESCRIPTION OF THE PREFERRED EMBODIMENTS

In accordance with the present invention, it has been discovered that a dried, cellulosic base sheet exhibiting reduced malodor upon re-wetting can be produced by topically applying a liquid glycol composition comprising a glycol compound to the web during the base sheet manufacturing process. The wet-laid cellulosic base sheets can be through-dried at higher drying gas temperatures and shortened dryer residence times while significantly reducing malodor produced upon re-wetting of the dried base sheets or finished cellulosic paper products made from the base sheets (e.g., hand towels). That is, the previous strategy of employing lower through-drying gas temperatures to reduce malodor formation upon re-wetting is obviated by the practice of the present invention with concomitant improvement in process throughput and productivity.

While the generation of odor in pulp material is not fully understood, it is believed that the odor may be due to extractives in the pulp that are oxidized/reduced during the bleaching and drying process. As part of the present invention, possible reaction mechanisms in the base sheet manufacturing process that may be contributing to the presence of odorous compounds in through-air dried cellulosic base sheets have been investigated. Without being held to a particular theory, it is believed that malodor released upon re-wetting base sheets dried at high temperatures is caused by reactions that form volatile organic compounds or odor precursors during drying. It is believed that these odorous compounds are formed within a cellulosic base sheet during through-air drying and bound within the sheet until the moment that the sheet or a finished paper product made from the sheet is re-wetted. The combination of acid in the sheet and the addition of water upon re-wetting cleaves the odorous compounds from the sheet and releases the compounds into the environment. In particular, experience to date suggests that a large number of the odor-causing compounds released from re-wetted base sheet material can be characterized as medium chain aliphatic aldehydes (e.g., octanal, nonanal, decanal) and/or furans (e.g., furfural, furfuryl alcohol, hydroxymethyl furfural). Thus, it is believed that the presence of volatile aldehyde compounds and/or furan compounds, either alone or in combination, may be responsible for the base sheet malodor. These odor-causing compounds may be produced during high temperature drying of the wet web by any conventional means including Yankee dryers and through-air dryers, but are particularly problematic in through-air dried base sheets, perhaps due to the highly oxidative environment and unique mass transfer phenomena provided by the air stream passing through the web.

Experience to date with analyzing re-wetted base sheets, as described, for example, in Example 1 below, indicates that a substantial component of the malodor released from through-air dried cellulosic base sheets upon re-wetting comprises medium-chain, aliphatic aldehydes having from about 7 to about 10 carbon atoms. Without being bound by a particular theory, it is believed that the aldehydes are formed within the base sheet by the oxidation of fatty acids present in the aqueous suspension of papermaking fibers. For example, during chlorine dioxide bleaching, which is typically conducted under acidic conditions at a pH of about 3.5, fatty acids present in the aqueous suspension of papermaking fibers are either bound by ester linkages to carbohydrates or oxidized to smaller aliphatic aldehydes. Alternatively, aldehydes may be formed in the base sheet during high temperature air-drying, wherein bound fatty acids within the web can be oxidized to aliphatic aldehydes by heating;

As water is driven from the web during drying, a portion of the aliphatic aldehydes present in the web may react with vicinal diols present in the carbohydrates to form acetal linkages, thus binding the aldehydes to the sheet fibers. This acetal formation between the aliphatic aldehydes and vicinal diols in a wet web base sheet is a reversible reaction, with equilibrium between the free aldehyde and bound acetal depending upon the amount of water present. As water is being driven from the web, the reaction favors acetal formation. When water is added, and especially in the presence of acid, the acetal will break down to an aldehyde. Therefore, it is believed that when the dried base sheet material is wetted with water (i.e., the sheet material is re-wetted), an acid-catalyzed reversal of the acetal formation reaction liberates the aldehyde, thus releasing the aldehyde from the base sheet material into the environment.

Analyses of organic extracts from re-wetted base sheets have also indicated the presence of furan components, in particular, furfural, furfuryl alcohol and hydroxymethyl furfural. These furans possess a burnt odor substantially similar to the odor released from the base sheets upon being re-wetted with water. Without being bound by a particular theory, it is believed that degradation of carbohydrates present in the base sheet occurs during through-air drying, to generate a furan precursor attached to the carbohydrates. The furan precursor is then liberated and released by an acid-catalyzed reaction when the base sheet material is re-wetted with water. While the liberation step could theoretically occur during further air-drying, it is believed that a rapid loss of water essentially leaves little or no solvent for subsequent reaction.

As noted above, it has been observed that a strong, burnt popcorn-like odor is sometimes emitted when water contacts paper hand towels made from cellulosic base sheet material that has been through-air dried at relatively high air temperatures. In accordance with the present invention, it has been found that topically applying a liquid glycol composition comprising a glycol compound to a web of papermaking fibers during the base sheet manufacturing process can counteract and substantially reduce the release of malodor released upon wetting (i.e., re-wetting) of the dried base sheet material in the final product. Without being bound to a particular theory, the glycol compound applied to the web may advantageously result in the formation of an ester complex with carboxylic acid groups and hemicellulose present within the web of papermaking fibers. This ester complex formation is believed to substantially neutralize or eliminate free carboxylic acid groups in the tissue web that would normally be available to partake in the generation of odorous compounds within the base sheet as previously described.

Examples of suitable glycol compounds for use in the practice of the present invention include polyethylene glycols, triethylene glycols, glycerol and mixtures thereof. A particularly preferred glycol compound is polyethylene glycol having a molecular weight of from about 400 to about 800, more preferably, having a molecular weight of about 600.

As will be recognized by those skilled in the papermaking art, the present invention is widely applicable to cellulosic base sheet manufacturing processes that include high temperature drying of the wet-laid web in an oxidative environment (e.g., air), and particularly to those processes in which the wet web is subjected to through-air drying. The practice of the present invention is readily integrated into cellulosic base sheet manufacturing processes and does not materially alter conventional practices except as otherwise noted herein. Conventional papermaking apparatus and techniques can be used with respect to preparation of the aqueous suspension of papermaking fibers or furnish, including pulping and bleaching, the sheet-forming process and tackle, headbox, sheet-forming fabrics, web transfers, transfer fabrics, dewatering, drying, creping, and the like, all of which are readily understood by those skilled in the art.

Papermaking fibers useful in the process of the present invention include any cellulosic fibers that are known to be useful for making cellulosic base sheets. Suitable fibers include virgin softwood and hardwood fibers along with non-woody fibers, as well as secondary (i.e., recycled) papermaking fibers and mixtures thereof in all proportions. Non-cellulosic synthetic fibers can also be included in the aqueous suspension. Papermaking fibers may be derived from wood using any known pulping process, including kraft and sulfite chemical pulps.

Additionally, the aqueous suspension of papermaking fibers may contain various additives conventionally employed by those skilled in the art, including, without limitation, wet strength resins (e.g., KYMENE, Hercules, Inc.), fillers and softening agents or debonders.

Suitable formation processes for forming the wet-laid web include Fourdrinier, roof formers (such as suction breast roll), and gap formers (such as twin wire formers, crescent formers), or the like. Sheet-forming fabrics or wires can also be conventional, with the finer weaves providing greater fiber support being preferred to produce a smoother sheet or web and the coarser weaves providing greater bulk. Fourdrinier formers are particularly useful for making the heavier basis weight sheets useful in the manufacture of paper hand towels and industrial wipers. Headboxes used to deposit the aqueous suspension of papermaking fibers onto the sheet-forming fabric can be layered or nonlayered.

The deposited wet-laid web is preferably partially dewatered before drying. Suitable dewatering techniques include vacuum dewatering (e.g., vacuum or suction boxes), air presses, and/or mechanical pressing operations.

The partially dewatered web may be dried by any means generally known in the art for making cellulosic base sheets, including, without limitation, Yankee dryers and through-air dryers. Preferably, a non-compressive drying method that tends to preserve the bulk or thickness of the wet web is employed. The present invention is particularly adapted for reducing objectionable odors emitted by through-air dried base sheets upon being re-wetted with water. Suitable through-drying apparatus and through-drying fabrics are conventional and well-known in the papermaking industry. The topical application of the glycol compound to the web counteracts the emission of malodor from the base sheet while permitting the use of desirably higher drying gas temperatures and shorter residence times in the through-drying apparatus, which in turn improves the productivity and throughput of the base sheet manufacturing process. Accordingly, it is preferred that the wet-laid web be through-dried by passing air or other drying gas heated to a temperature of at least about 175° C. through the web. More preferably, the air passed through the web is heated to a temperature of at least about 180° C., even more preferably at least about 190° C. Typically, the drying gas temperature for a through-drying operation will be from about 190° to about 220° C., more preferably from about 190° to about 210° C. and especially from about 200° to about 205° C. One skilled in the art can readily determine the optimum drying gas temperature and sheet residence time for a particular through-drying operation.

It is contemplated that the liquid glycol composition can be topically applied at anytime during the base sheet manufacturing process once the wet-laid web has been deposited onto the sheet-forming fabric. It is further contemplated that the liquid glycol composition can be topically applied as an offline finishing treatment after the dried web has been removed from the papermaking machine (e.g., "off the roll" after cutting and/or splitting). For example, the glycol compound may be applied to a partially dewatered web (i.e., a web having a dry weight consistency of from about 20% to about 80%) before the web is subjected to final drying. Alternatively, the liquid glycol composition can be topically applied to a substantially dewatered and/or dried web having a dry weight consistency of at least about 80%. In accordance with one preferred embodiment, the liquid glycol composition is applied to a substantially dry web having a dry weight consistency of at least about 90%, at least about 95% or even at least about 99%, for example, after the through-air drying stage and prior to winding the dried web (i.e., base sheet) on a roll at the end of the papermaking machine). It is also contemplated that the glycol compound may be introduced into the aqueous suspension of papermaking fibers by means other than topical application to the web (e.g., by introducing the glycol compound to the aqueous suspension of papermaking fibers during pulping or by introducing the glycol compound to the papermaking fiber stock prior to pulping). However, experience to date suggests that the glycol compounds used in the process of the invention are not adequately retained by the papermaking fibers when added to the aqueous suspension of the papermaking fibers prior to deposition onto the sheet-forming fabric. Without being held to a particular theory, it is believed that the hydrophilic nature of the glycol compounds used in the present invention results in poor retention of the glycol compound on the papermaking fibers in the presence of a significant amount of water (i.e., if the dry weight consistency of the papermaking fibers is less than about 10%).

The amount of glycol compound applied to the web by topical application of the liquid glycol composition should be sufficient to substantially inhibit the formation of undesirable odors when cellulosic paper products (e.g., hand towels) formed from the dried base sheet material are re-wetted. Generally, suitable results are obtained by topically applying the liquid glycol composition to the web in an amount sufficient such that the add-on amount of glycol compound applied to the web is from about 0.5% to about 20% by weight based on the weight of papermaking fibers in the web. For example, when the liquid glycol composition to be topically applied to the web comprises polyethylene glycol, the polyethylene glycol is preferably applied in an add-on amount of from about 0.5% to about 20%, more preferably, from about 0.5% to about 5%, and even more preferably from about 1% to about 2% by weight based on the weight of papermaking fibers in the web. When the liquid glycol composition to be topically applied to the web comprises triethylene glycol or glycerol as the glycol compound, the glycol compound is preferably applied in an add-on amount of from about 1% to about 5% by weight based on the weight of papermaking fibers in the web. Smaller amounts of glycol composition may also be effective for some reduction in the intensity of malodor emanating from cellulosic paper products upon re-wetting. However, it is important to apply the glycol compound to the web in an amount sufficient to ensure uniform dispersion of the glycol compound across the papermaking fibers of the web.

It is contemplated that the glycol compound may be topically applied to the web in any form, for example, in the form of a substantially pure liquid glycol composition consisting essentially of glycol compound (e.g., 100% polyethylene glycol). In carrying out such practice, it may be necessary to maintain the pure glycol composition at more elevated temperatures to ensure that it remains in the liquid state and suitable for topical application to the web. In an alternate embodiment, the liquid glycol composition applied to the web may comprise the glycol compound dispersed in an aqueous solution. Typically, an aqueous solution containing from about 1% to about 80% by weight of the glycol compound may be employed as the liquid glycol composition. For example, when polyethylene glycol having a molecular weight of about 600 is the glycol compound to be topically applied to the web, polyethylene glycol 600 is preferably applied as an aqueous solution containing from about 1% to about 80% by weight polyethylene glycol in water, more preferably from about 20% to about 60% by weight polyethylene glycol in water. When the liquid glycol composition is topically applied to a substantially dry web (e.g., after through-air drying), the glycol compound is preferably applied as part of an aqueous solution to facilitate the dispersion of the glycol compound onto the dried web.

Whether applied as a substantially pure glycol compound or as an aqueous solution of the glycol compound, the liquid glycol composition may be topically applied to the web by any suitable means known in the art. For example, suitable methods for applying the liquid glycol composition to the web include, but are not limited to, spraying, rotogravure printing, trailing blade coating and the like.

In one particular embodiment of the present invention, the liquid glycol composition, preferably comprising polyethylene glycol having a molecular weight of from about 400 to about 800, is topically applied to a partially dewatered web of papermaking fibers before the web is subjected to through-drying. For example, after depositing the aqueous suspension of papermaking fibers to form a wet-laid web, the web is partially dewatered to form a partially dewatered web having a dry weight consistency of from about 20% to about 80% (e.g., having a fiber consistency of about 20%, 25%, 30%, 35%, 40%, 50%, 60%, 70% or 80%). The liquid glycol composition is then topically applied to the partially dewatered web as described above and the web is thereafter dried.

In another embodiment of the present invention, the liquid glycol composition is topically applied to a substantially dry web before finish processing. For example, after depositing the wet-laid web of papermaking fibers, the wet web is dewatered and/or dried to form a substantially dry web having a dry weight consistency of at least about 80%, at least about 90%, at least about 95% or even at least about 99%. The web may be dewatered and/or dried by any conventional means described above, preferably including a high-temperature, non-compressive drying such as through-air drying. The liquid glycol composition, preferably in the form of an aqueous solution of the glycol compound, is then topically applied to the substantially dry web (e.g., after the drying stage and prior to being wound on roll at the end of the papermaking machine). Depending on the dry weight consistency of the substantially dry web, the web may be further dried (e.g., air-dried, oven-dried or through-dried) after application of the glycol compound and before finishing or other processing. In a still further embodiment of the present invention, the liquid glycol composition is topically applied to a substantially dry web as an offline finishing treatment after the dried web has been removed from the papermaking machine (e.g., "off the roll" after cutting and/or splitting). As noted above, it is important that the glycol compound be uniformly dispersed over the surface of the dried web. Thus, it is preferred that the liquid glycol composition applied to a substantially dry web be an aqueous solution of the glycol compound. Preferably, the solution applied to the dried web comprises from about 1% to about 80% by weight glycol compound, more preferably from about 20% to about 60% by weight glycol compound, and especially about 40% by weight glycol compound in water. In order to further enhance uniform dispersion of the glycol compound over the dried web and improve odor control, a surfactant (i.e., wetting agent) may be introduced into the aqueous solution of the glycol compound in an amount of about 1% of the weight of glycol compound present in the solution. Suitable surfactants include, for example, the TWEEN Series of surfactants available from Uniqema (New Castle, Del., USA) and the SURFYNOL Series of surfactants available from Air Products and Chemicals, Inc. (Allentown, Pa., USA). The glycol compound or aqueous solution of the glycol compound may be topically applied to the dried web by any means known in the art as described above, preferably by spraying, especially in an enclosure for containing the spray and optionally including means for collecting over-spray such as a vacuum box. For example, in a preferred embodiment wherein a liquid glycol composition comprising about 40% by weight polyethylene glycol in an aqueous solution is topically applied to a substantially dried web, the aqueous solution is topically applied to the web in an add-on amount of from about 1% to about 5% by weight, preferably in an add-on amount of from about 2% to about 3% by weight of the papermaking fibers in the web, to provide an add-on amount of polyethylene glycol of from about 0.75% to about 2% by weight, preferably from about 1% to about 1.5% by weight of the papermaking fibers in the web.

Individual cellulosic paper products made from the base sheets produced in accordance with the present invention may include, for example, absorbent hand towels, industrial wipers, tissues, napkins and the like of one or more plies and varying finish basis weights. For multi-ply products, it is not necessary that all plies of the product be the same, provided that at least one ply is made in accordance with the present invention. Suitable basis weights for these products can be from about 5 to about 70 grams/$m^2$. In accordance with a preferred embodiment, the cellulosic paper products have a finish basis weight ranging from about 25 to about 45 grams/$m^2$, even more preferably from about 30 to about 40 grams/$m^2$.

The process of the present invention has not been found to significantly alter the physical properties of the cellulosic base sheet products produced by the process in any capacity other the substantial reduction in the release of malodor upon re-wetting. For example, through-dried cellulosic base sheets produced by the process of the invention generally contain an amount of stretch of from about 5% to about 40%, preferably from about 15% to about 30%. Further, products of this invention can have a machine direction tensile strength of about 1000 grams or greater, preferably about 2000 grams or greater, depending on the product form, and a machine direction stretch of about 10% or greater, preferably from about 15% to about 25%. More specifically, the preferred machine direction tensile strength for products of the invention may be about 1500 grams or greater, preferably about 2500 grams or greater. Tensile strength and stretch are measured according to ASTM D1117-6 and D1682. As used herein, tensile strengths are reported in grams of force per 3 inches (7.62 centimeters) of sample width, but are expressed simply in terms of grams for convenience.

The aqueous absorbent capacity of the products of this invention is at least about 500% by weight, more preferably about 800% by weight or greater, and still more preferably about 1000% by weight or greater. It refers to the capacity of a product to absorb water over a period of time and is related to the total amount of water held by the product at its point of saturation. The specific procedure used to measure the aqueous absorbent capacity is described in Federal Specification No. UU-T-595C and is expressed, in percent, as the weight of water absorbed divided by the weight of the sample product.

The products of this invention can also have an aqueous absorbent rate of about 1 second or less. Aqueous absorbent rate is the time it takes for a drop of water to penetrate the surface of a base sheet in accordance with Federal Specification UU-P-31b.

Still further, the oil absorbent capacity of the products of this invention can be about 300% by weight or greater, preferably about 400% by weight or greater, and suitably from about 400% to about 550% by weight. The procedure used to measure oil absorbent capacity is measured in accordance with Federal Specification UUT 595B.

The products of this invention exhibit an oil absorbent rate of about 20 seconds or less, preferably about 10 seconds or less, and more preferably about 5 seconds or less. Oil absorbent rate is measured in accordance with Federal Specification UU-P-31b.

The following examples are simply intended to further illustrate and explain the present invention. This invention, therefore, should not be limited to any of the details in these examples.

EXAMPLE 1

This example demonstrates an experiment designed to determine the relative odor intensity of compounds released from through-dried cellulosic base sheets manufactured by a conventional Un-Creped Through-Air Dried (UCTAD) process without application of a glycol compound to the wet-laid web of papermaking fibers. The experiment employed a CHARM analysis to determine the relative odor intensity of each compound. The CHARM protocol is described generally, for example, by Acree et al. in *Food Chem.*, 184:273-86 (1984), which is incorporated herein by reference. As described by Acree et al., the CHARM analysis comprises sequentially diluting a series of samples to determine the strongest smelling components of a sample.

The experiment comprised wetting samples of through-dried cellulosic base sheets (ranging from about 6 to about 20 g of pulp) with water. The gases evolved from the wetted base sheets were concentrated onto a sorbent trap commercially available from Envirochem, Inc. and containing 150 mg each of glass beads/Tenax TA/Ambersorb/charcoal and then thermally desorbed into a gas chromatograph (GC) (such as a HP 5890 GC commercially available from Hewlett-Packard, Inc.) and/or a gas chromatograph/mass spectrometer (GC/MS) (such as a HP 5988 commercially available from Hewlett-Packard, Inc.). The gas chromatograph was also fitted with a sniffer port to allow the operator to determine if the eluted compounds had an odor, a procedure described as gas chromatograph olfactometry (GCO). Each eluted compound that produced an odor at the sniffer port was recorded. A voice actuated tape recorder was used to record sensory impressions. The sample was then diluted and analyzed again.

Different sample sizes were analyzed until no odor components could be detected. The largest sample size (16 g) was analyzed three times to ensure that all odorous compounds were detected. Thereafter, only the retention times of compounds determined to be odorous were evaluated in duplicate. Each successive sample was diluted to comprise one-third the amount of material of the previous sample.

Results and Discussion

The GC/MS chromatograms indicated that numerous compounds were evolved from the re-wetted through-dried cellulosic base sheets. In a typical analysis, each peak of the chromatograms would be assigned to a particular chemical and a literature search would be undertaken to determine which of the chemicals have an odor. Since relatively few compounds have published odor thresholds, it would be difficult to determine whether an individual chemical would be odorous at the concentrations present in the sample. Thus, the ability to determine which peaks are odorous using GCO greatly simplifies the task of identifying the compounds responsible for the odor.

From all the compounds detected, only 17 peaks were found to possess an odor by GCO. CHARM analysis determined that two peaks accounted for more than 70% of the odor intensity, with four peaks comprising 85% of the odor intensity. From the combination of CHARM and GC/MS analysis, it is clear that the odor can be attributed to aldehydes. The most odorous compounds appear to be $C_7$-$C_{10}$ aldehydes (e.g., octanal, nonanal, and decanal) which have odor thresholds typically ranging from about 100 parts per trillion (ppt) to about 3 parts per billion (ppb).

EXAMPLE 2

This example demonstrates the introduction of a glycol compound onto a partially dewatered web as a treatment for reducing malodor released from through-air dried hand sheets upon re-wetting.

Sample hand sheets or towels were prepared by forming an aqueous suspension of papermaking fibers and depositing the suspension onto a sheet-forming fabric. The tissue web was then 30-40% dewatered. Each of the sample hand sheets was sprayed with one of the glycol compounds shown below and the were dried at 177-204° C. After re-wetting, the hand sheets were each tested for odor intensity with the following results:

| Sample | Treatment Added | Odor Intensity (0-5 scale) |
|---|---|---|
| 1 | Untreated | 2 |
| 2 | 3% Polyethylene glycol 600 | 0-1 |
| 3 | 5% Polyethylene glycol 600 | 0 |
| 4 | 10% Polyethylene glycol 600 | 0 |
| 5 | 20% Polyethylene glycol 600 | 0 |
| 6 | 5% Glycerol | 0 |

EXAMPLE 3

Sample hand sheets or towels were prepared as described in Example 2. Solutions comprising 3% polyethylene glycol 600 in water and 5% polyethylene glycol 600 in water were sprayed onto the samples which were then dried. Upon being re-wetted, the samples were tested for odor intensity with the following results:

| | | Sheet Wt. | | | |
|---|---|---|---|---|---|
| Sample | Treatment | Before Treatment | After Treatment | After Drying | Odor |
| 1 | 3% PEG 600 | 5.11 g | 6.12 g | 1.51 g | None |
| 2 | 3% PEG 600 | 4.04 g | 5.48 g | 1.38 g | None |
| 3 | 5% PEG 600 | 3.28 g | 4.44 g | 1.32 g | None |
| 4 | 5% PEG 600 | 3.65 g | 4.94 g | 1.45 g | None |

Thus, none of the treated samples was determined to emit any detectable odor.

EXAMPLE 4

Sample hand towels were prepared as described in Example 2. Samples were sprayed with three different solutions of polyethylene glycol 600 in water and then air dried. Upon re-wetting, the samples were tested for odor intensity with the following results:

A) 1.5% polyethylene glycol 600 in water

| Initial Towel Wt. | Final Towel Wt. | Odor | % PEG Added |
|---|---|---|---|
| 2.137 g | 2.930 g | None | 37% |
| 2.037 g | 3.066 g | None | 46.7% |
| 2.061 g | 2.750 g | None | 33.4% |

B) 2% polyethylene glycol 600 in water

| Initial Towel Wt. | Final Towel Wt. | Odor | % PEG Added |
|---|---|---|---|
| 2.122 g | 3.488 g | None | 64.37% |
| 2.060 g | 2.944 g | None | 43% |
| 2.026 g | 2.887 g | None | 42.4% |

C) 3% polyethylene glycol 600 in water

| Initial Towel Wt. | Final Towel Wt. | Odor | % PEG Added |
|---|---|---|---|
| 2.092 g | 3.722 g | None | 77.9% |
| 2.061 g | 2.903 g | None | 40.8% |
| 2.109 g | 2.808 g | None | 33.14% |

EXAMPLE 5

Hand sheets or hand towels were prepared on a continuous hand sheet former (CHF) by first forming an aqueous suspension of papermaking fibers, forming a tissue web by depositing the fibers onto a forming wire, rendering the web 30% dewatered and then topically applying to the web the materials indicated in the following table. A total of 16 panelists evaluated the products by ranking them from least to most for the intensity of overall objectionable odor. The rank sums were analyzed with Friedman and Tukey statistics to compare the products with one another.

The table below summarizes the primary analysis. The untreated base sheet had the strongest level of objectionable odor among the products while the prototype with 20% polyethylene glycol 600 had the lowest level.

| Product Rankings for Objectionable Odor | |
|---|---|
| Untreated | 73 |
| 3% PEG 600 | 59 |
| 5% PEG 600 | 49 |
| 10% PEG 600 | 50 |
| 20% PEG 600 | 32 |
| 5% Glycerol | 54 |

Note: The higher the rank sum, the higher the level of objectionable odor.

In view of the above, it will be seen that the several objects of the invention are achieved and other advantageous results attained.

The present invention is not limited to the above embodiments and can be variously modified. The above description of the preferred embodiments, including the Examples, is intended only to acquaint others skilled in the art with the invention, its principles, and its practical application so that others skilled in the art may adapt and apply the invention in its numerous forms, as may be best suited to the requirements of a particular use.

With reference to the use of the word(s) comprise or comprises or comprising in this entire specification (including the claims below), unless the context requires otherwise, those words are used on the basis and clear understanding that they are to be interpreted inclusively, rather than exclusively, and that each of those words is to be so interpreted in construing this entire specification.

What is claimed is:

1. A process for manufacturing a cellulosic paper product, the process comprising:

forming an aqueous suspension of papermaking fibers;

depositing said aqueous suspension of papermaking fibers onto a sheet forming fabric to form a wet web;

partially dewatering said web;

through drying said partially dewatered web by passing air heated to a temperature of at least about 175° C. through said web; and topically applying a liquid glycol composition comprising a glycol compound selected from the group consisting of polyethylene glycol, triethylene glycol, glycerol and mixtures thereof to said dried web having a dry weight consistency of at least about 90% by weight.

2. A process as set forth in claim 1 wherein said liquid glycol composition comprises triethylene glycol.

3. A process as set forth in claim 1 wherein said liquid glycol composition comprises glycerol.

4. A process as set forth in claim 1 wherein said liquid glycol composition comprises polyethylene glycol having a molecular weight of from about 400 to about 800.

5. A process as set forth in claim 1 wherein said liquid glycol composition comprises polyethylene glycol having a molecular weight of about 600.

6. A process as set forth in claim 1 wherein said liquid glycol composition is topically applied to said web in an amount sufficient such that the add on amount of polyethylene glycol applied to said web is from about 0.5% to about 20% by weight based on the weight of papermaking fibers in said web.

7. A process as set forth in claim 6 wherein said liquid glycol composition is topically applied to said web in an amount sufficient such that the add on amount of polyethylene glycol applied to said web is from about 0.5% to about 5% by weight based on the weight of papermaking fibers in said web.

8. A process as set forth in claim 7 wherein said liquid glycol composition is topically applied to said web in an amount sufficient such that the add on amount of polyethylene glycol applied to said web is from about 1% to about 2% by weight based on the weight of papermaking fibers in said web.

9. A process as set forth in claim 1 wherein said liquid glycol composition topically applied to said web consists essentially of polyethylene glycol.

10. A process as set forth in claim 1 wherein said liquid glycol composition topically applied to said web is an aqueous solution comprising from about 1% to about 80% by weight polyethylene glycol.

11. A process as set forth in claim 10 wherein said liquid glycol composition topically applied to said web is an aqueous solution comprising from about 20% to about 60% by weight polyethylene glycol.

12. A process as set forth in claim 11 wherein said liquid glycol composition topically applied to said web is an aqueous solution comprising about 40% by weight polyethylene glycol.

13. A process as set forth in claim 12 wherein said liquid glycol composition is topically applied to said web in an add on amount of about 2% to about 5% by weight based on the weight of papermaking fibers in said web.

14. A process as set forth in claim 10 wherein said liquid glycol composition further comprises a surfactant.

15. A process as set forth in claim 14 wherein the concentration of surfactant in said liquid glycol composition is about 1% based on the weight of glycol compound in the liquid glycol composition.

16. A process as set forth in claim 1 wherein said liquid glycol composition is topically applied to said dried web by spraying.

17. A process a set forth in claim 1 wherein said dried web to which said liquid glycol composition is applied has a dry weight consistency of at least about 95%.

18. A process as set forth in claim 17 wherein said dried web to which said liquid glycol composition is applied has a dry weight consistency of at least about 99%.

19. A process as set forth in claim 1 wherein said liquid glycol composition is applied to said dried web prior to winding said dried web on a roll.

20. A process as set forth in claim 1 wherein the air passed through said web is heated to a temperature of at least about 180° C.

21. A process as set forth in claim 20 wherein the air passed through said web is heated to a temperature of at least about 190° C.

22. A process as set forth in claim 21 wherein the air passed through said web is heated to a temperature of from about 190° to about 210° C.

23. A process as set forth in claim 22 wherein the air passed through said web is heated to a temperature of from about 200° to about 205° C.

* * * * *

UNITED STATES PATENT AND TRADEMARK OFFICE

CERTIFICATE OF CORRECTION

PATENT NO. : 7,297,228 B2
APPLICATION NO. : 10/361841
DATED : November 20, 2007
INVENTOR(S) : Anderson et al.

It is certified that error appears in the above-identified patent and that said Letters Patent is hereby corrected as shown below:

In column 10, line 23, delete “the were” and insert therefor -- the samples were --.

Signed and Sealed this

Twenty-ninth Day of July, 2008

JON W. DUDAS
*Director of the United States Patent and Trademark Office*